US007284517B2

(12) United States Patent
Lancefield et al.

(10) Patent No.: US 7,284,517 B2
(45) Date of Patent: Oct. 23, 2007

(54) CAMSHAFT TO PHASER COUPLING

(75) Inventors: Timothy Mark Lancefield, Shipston on Stour (GB); Richard Alwyn Owen, Banbury (GB)

(73) Assignee: Mechadyne PLC, Kirtlington (GB)

( * ) Notice: Subject to any disclaimer, the term of this patent is extended or adjusted under 35 U.S.C. 154(b) by 0 days.

(21) Appl. No.: 11/372,765

(22) Filed: Mar. 10, 2006

(65) Prior Publication Data

US 2006/0207538 A1 Sep. 21, 2006

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2002/0059910 A1* 5/2002 Methley et al. ..... 123/90.17

* cited by examiner

*Primary Examiner*—Thomas Denion
*Assistant Examiner*—Zelalem Eshete
(74) *Attorney, Agent, or Firm*—Smith-Hill and Bedell

(57) ABSTRACT

An engine is described having a camshaft 10 formed of an inner shaft 12 and an outer tube 14 both of which rotate with respective groups of cams 18 and 16. A drive train driving both the inner shaft 12 and the outer tube from the engine crankshaft includes a phaser 30 for enabling the phase of at least one of the groups of cams 16 and 18 to be varied dynamically relative to the phase of the crankshaft. The phaser is secured to the front end of the outer tube 14 and the inner shaft 12 of the camshaft 10 is connected to the front side 36 of the phaser 30 by way of a driving member 46 that encloses the component 40 securing the phaser to the outer tube 14 of the camshaft 10.

11 Claims, 1 Drawing Sheet

CAMSHAFT TO PHASER COUPLING

CROSS REFERENCE TO RELATED APPLICATION

This application claims priority under 35 USC 119 of United Kingdom Patent Application No. 0505497.8 filed Mar. 18, 2006.

FIELD OF THE INVENTION

The invention relates to an engine having a crankshaft, a camshaft formed of an inner shaft and an outer tube both of which rotate with respective groups of cams, a drive train connected to drive both the inner shaft and the outer tube from the engine crankshaft, a phaser for enabling the phase of at least one of the groups of cams to be varied dynamically relative to the phase of the crankshaft, and means for mounting the phaser to the front of the camshaft. The invention is particularly concerned with the manner in which the inner drive shaft and outer tube of the camshaft are connected to the front and rear plates of the phaser whose timing can be controlled relative to the crankshaft.

BACKGROUND OF THE INVENTION

A camshaft formed of an inner shaft and an outer tube both of which rotate with respective groups of cams, is known and is termed herein a single cam phaser (SCP) camshaft. GB 2 369 175 also teaches that a vane type phaser may be fitted to an SCP camshaft in order to control the timing of the inner shaft or the outer tube relative to the crankshaft.

In GB 2 369 175, and other prior art references such as EP 0 254 058 and US 2003/0154944, in which a phaser is mounted on the front end of an SCP camshaft, the phaser is held axially against the end of the camshaft by being bolted to a front end of the inner drive shaft. This results in radial drive loads from the timing chain or belt of the drive train being transmitted through the front bearing supporting the inner shaft in the outer tube.

OBJECT OF THE INVENTION

The invention seeks to provide an engine in which drive loads are transmitted directly from the phaser to the outer tube so that the inner shaft is used only to transmit torque and is not subjected to any radial loads.

SUMMARY OF THE INVENTION

According to the present invention, there is provided an engine having two groups of cams, a camshaft driven in operation by a crankshaft of the engine and formed of an inner shaft and an outer tube each of which rotates with a respective one of the two groups of cams, a phaser for enabling the phase of at least one of the groups of cams to be varied dynamically relative to the phase of the engine crankshaft, and means for mounting the phaser to a front end of the camshaft, wherein the means for mounting the phaser to the front end of the camshaft comprises a component arranged on the front side of the phaser and coupled to the outer tube of the camshaft to retain the phaser axially on the outer tube of the camshaft, and a driving member overlying the component axially retaining the phaser on the outer tube of the camshaft and coupling the front side of the phaser for rotation with the inner shaft of the camshaft.

The invention provides a way of mounting the camshaft phaser directly to the camshaft tube and connecting the inner drive shaft to the phaser without transmitting any radial forces to the inner drive shaft. This is achieved by providing a separate driving member to connect the front output plate of the phaser to the inner shaft that is fitted after the phaser has been axially secured in position on the outer shaft. This additional driving member can also be used to contain all of the oil supply interfaces for controlling the phaser, and can be designed in a compliant manner so as to eliminate any misalignments without introducing angular flexibility into the system. The compliance can also be used to control the end float of the inner drive shaft within the camshaft tube by preloading the shaft in one direction.

As compared with existing designs, the invention offers the advantages that the weight of the phaser and the forces from the chain/belt drive from the crankshaft are supported by the camshaft tube, rather than the inner drive shaft. Consequently, the inner drive shaft does not have any radial forces applied to it by the camshaft phaser and this removes the need for accurate location bearings for the shaft inside the tube. The lack of bearings allows the component tolerances of the SCP camshaft to be relaxed because the moving cam sections only rely on the drive shaft for their angular position. Furthermore, the front drive member can be designed with compliance to eliminate tolerance build up.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
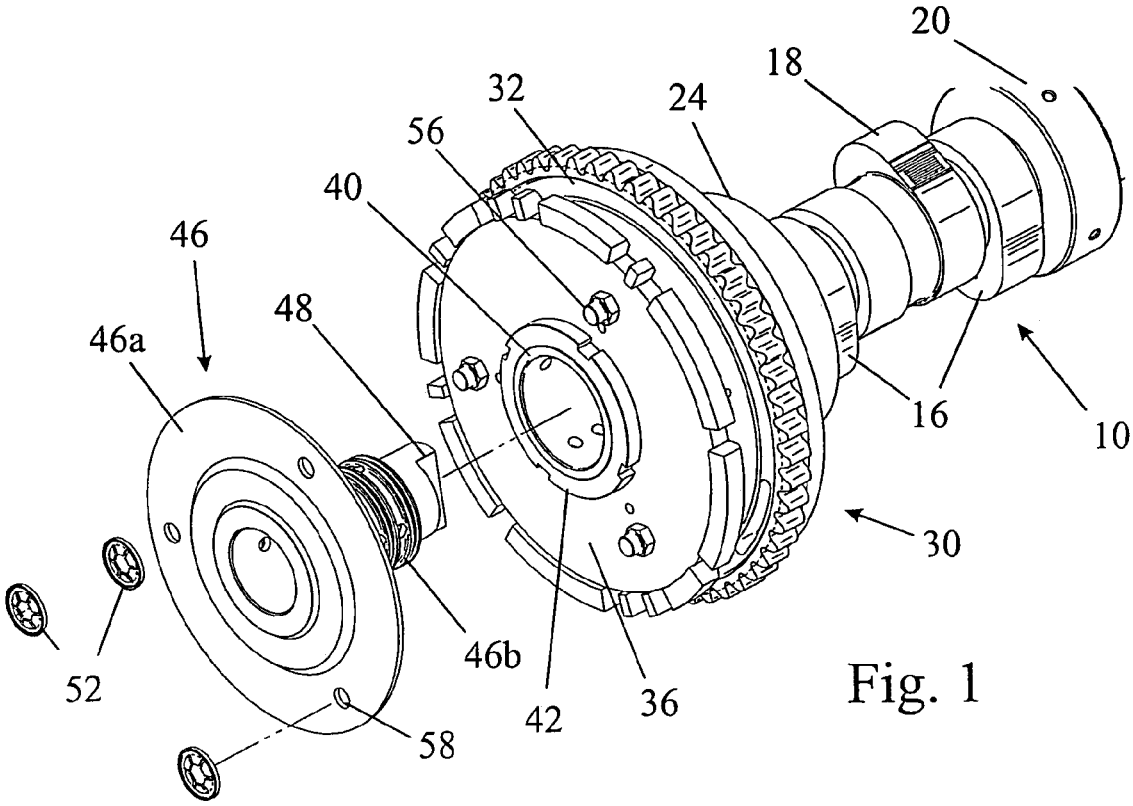
FIG. 1 is a perspective partly exploded view of a phaser mounted on the front end of an SCP camshaft.
Figure 2:
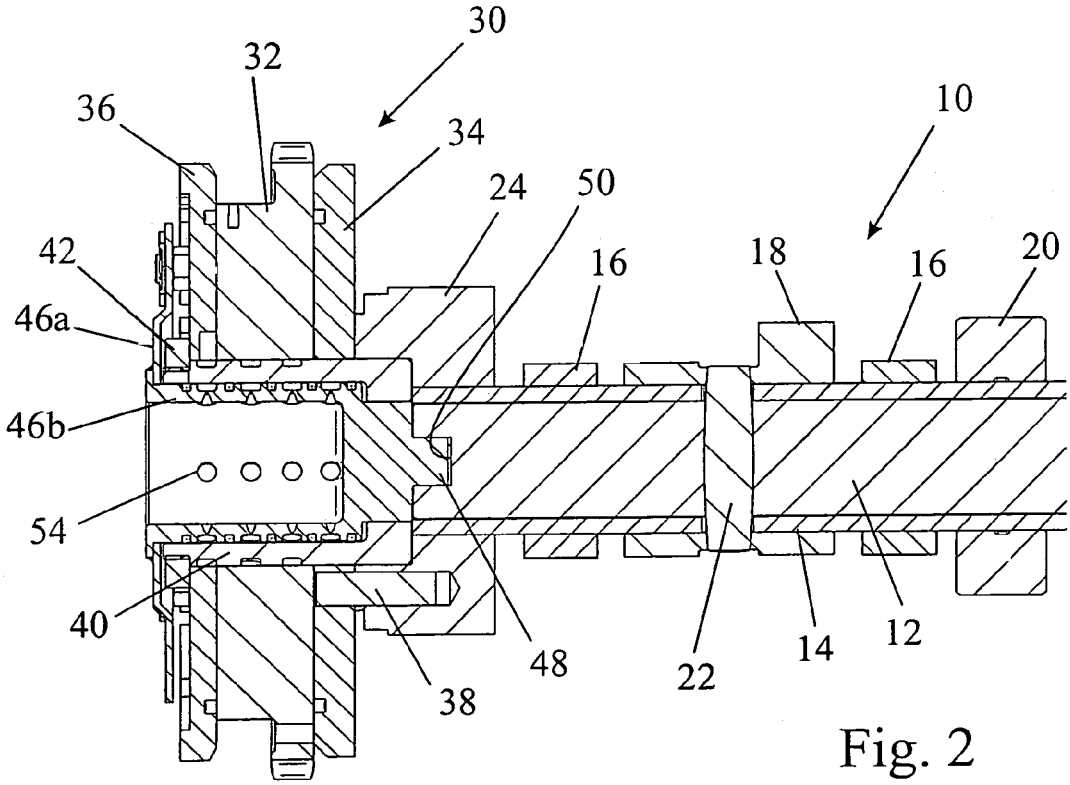
FIG. 2 is a section through the camshaft and phaser of FIG. 1.

FIGS. 1 and 2 show the basic arrangement of the invention, having a phaser 30 driven by the crankshaft (not shown) and mounted on the front end of an SCP camshaft 10. The camshaft 10 has an inner shaft 12 and an outer tube 14. A first group of cams 16 is mounted for rotation with the outer tube 14 while a second group of cams 18 is free to rotate about the outer tube 14 and is coupled for rotation with the inner shaft 12 by means of pins 22 that pass through circumferentially elongated holes in the outer tube 14. The camshaft 10 is fitted with bearings 20 staggered along its length and in a bearing 24 at the front end of the engine. The term "front" is used herein to denote the end of the engine at which the crankshaft pulley driving the camshaft is arranged. In relation to the phaser 30, the term "front" refers to the side viewed from the front of the engine and the "rear" is the side facing the camshaft 10.

The phaser 30 is a vane-type phaser having a driven member or hub 32 formed with sprocket teeth that is driven by the crankshaft by way of a toothed belt or chain. On the opposite sides of the hub 32, the phaser has two end plates 34 and 36 that act as drive or output members. Arcuate hydraulic working chambers (not shown) are defined within the phaser 30 to allow the end plates 34 and 36 to be rotated relative to the hub 32. In this way, the phase of each of the end plates 34 and 36 can be adjusted in relation to the phase of the crankshaft by controlling the hydraulic fluid supply to the working chambers of the phaser.

The camshaft phaser 30 is supported on a nose 40 that is fixed to, or made as part of, the front camshaft bearing 24 and is retained by a nut 42 threaded on to the front of the nose 40. As a result, any radial loading on the hub 32 is transmitted directly to the front bearing 24 of the camshaft 10 through the nose 40.

The rear plate 34 of the phaser 30 is coupled by means of a pin 38 for rotation with the front bearing 24 so as to drive the outer tube 14 of the camshaft 10.

A driving member 46 for connecting the front plate 36 for rotation with the inner shaft 12 of the camshaft 10 is inserted into the front of the camshaft after the nut 42 has been tightened. The driving member 46 is formed of a tubular portion 46*b* that fits within the nose 40 and a front flange 46*a* that covers the nut 42. The tubular portion 46*b* has a key 48 at its end that engages in a slot 50 in the front end of the inner shaft 12 while the flange 46*a* is held against the front plate 36 by means of spring clips 52 fitted over posts 56 that project from the end plate 36 through holes 58 in the flange 46*a*.

The nose 40 and the tubular portion of the driving member 46 have passages 54 to allow hydraulic fluid to flow in and out of the working chambers of the phaser, the fluid being supplied through a connector mounted on a front cover of the engine and received together with suitable rotary seals within the tubular portion 46*b*.

Instead of fitting spring clips 52 over posts 56 projecting through holes 58 in the flange 46A, conventional threaded fasteners could be used to secure the flange 46*a* to the plate 36. It would also be possible to use a bolt to transmit drive to the front of the inner drive shaft 12 from the tubular portion 46*b* of the driving member 46.

The driving member 46 is shown as a two-part assembly that is welded together, but it would be alternatively possible to produce it as a single part. The tubular portion 46*b* contains all of the oil drillings 54 necessary to connect to a hydraulic valve for controlling the phaser, whilst the flange 46*a* provides the connection to the front plate 36 of the phaser. The flange can be made to act as a disk spring to provide some flexibility between the connection to the phaser front plate 36 and the inner shaft 12. This design is still stiff in a rotational sense, but allows some movement in the axial direction and allows the axis of the tubular portion 46*b* to conform to that of the camshaft nose 40.

The compliance of the flange 46*a* also provides a method for controlling the end float of the inner shaft 12 within the outer tube 14 by pre-loading the inner drive shaft towards the rear of the camshaft 10.

It will be clear that various modifications may be made to the described embodiment without departing from the scope of the invention as set out in the appended claims. For example an Oldham coupling may be used between the tubular portion 46*b* of the driving member 46 and the end of the inner shaft 12 to compensate for misalignment of the driving member 46.

The invention claimed is:

1. An engine having two groups of cams, a camshaft driven in operation by a crankshaft of the engine and formed of an inner shaft and an outer tube each of which rotates with a respective one of the two groups of cams, a phaser for enabling the phase of at least one of the groups of cams to be varied dynamically relative to the phase of the engine crankshaft, the phaser having a rear side coupled to the outer tube of the camshaft and also having a front side, and means for mounting the phaser to a front end of the camshaft, wherein the means for mounting the phaser to the front end of the camshaft comprises a tubular portion rigid with the outer tube of the camshaft, passing at least partly through the phaser, and having a front end accessible from the front side of the phaser and coupled to the outer tube of the camshaft to retain the phaser axially on the outer tube of the camshaft, and a driving member overlying the front end of said tubular portion and coupling the front side of the phaser for rotation with the inner shaft of the camshaft.

2. An engine as claimed in claim 1, wherein the driving member includes oil passages for supplying oil to the phaser.

3. An engine as claimed in claims 1, wherein the driving member includes an axially compliant part.

4. An engine as claimed in claim 3, wherein the driving member serves to preload the inner shaft into a defined axial position within the outer tube.

5. An engine as claimed in claim 1, wherein the driving member is connected to the inner shaft by means of a keyway slot.

6. An engine as claimed in claim 1, wherein the driving member is connected to the inner shaft by means of a threaded fixing.

7. An engine as claimed in claim 1, wherein the driving member is connected to the inner shaft by means of an Oldham coupling.

8. An engine as claimed in claim 1, wherein the driving member is connected to the front side of the phaser by means of driving posts and self-retaining clips.

9. An engine as claimed in claim 1, wherein the driving member is connected to the front side of the phaser by means of threaded fasteners.

10. An engine as claimed in claim 1, wherein the phaser is radially supported on the tubular portion such that radial loads on the phaser are transmitted to the outer tube of the camshaft and the tubular portion retains the phaser axially against the outer tube of the camshaft.

11. An engine as claimed in claim 1, wherein the phaser comprises a front plate coupled to the driving member, a rear plate coupled to the outer rube of the camshaft, and a driven member between the front and rear plates and provided with formations for coupling drive from the engine crankshaft to the driven member.

* * * * *